United States Patent [19]

Wolf

[11] Patent Number: 4,592,197

[45] Date of Patent: Jun. 3, 1986

[54] RING-SPINNING OR RING-TWISTING MACHINE WITH RESTART CONTROL

[75] Inventor: Horst Wolf, Albershausen, Fed. Rep. of Germany

[73] Assignee: Zinser Textilmaschinen GmbH, Ebersbach/Fils, Fed. Rep. of Germany

[21] Appl. No.: 657,781

[22] Filed: Oct. 4, 1984

[30] Foreign Application Priority Data

Oct. 4, 1983 [DE] Fed. Rep. of Germany ..... 3336040

[51] Int. Cl.[4] ..... D01H 13/14; D01H 1/20; B65H 54/28

[52] U.S. Cl. ..... 57/277; 57/81; 57/99; 57/264; 242/26.1

[58] Field of Search ..... 57/95, 78, 98, 81, 99, 57/264, 277, 265; 242/26.1–26.5

[56] References Cited

U.S. PATENT DOCUMENTS

| | | | |
|---|---|---|---|
| 3,075,342 | 1/1963 | Lohest et al. | 57/277 |
| 3,097,475 | 7/1963 | Hooper et al. | 57/277 X |
| 3,245,215 | 4/1966 | Graf | 57/99 |
| 3,357,167 | 12/1967 | Jones, Sr. et al. | 57/277 |
| 3,397,529 | 8/1968 | Wolf | 57/99 X |
| 3,406,919 | 10/1968 | Turk et al. | 57/277 X |
| 3,604,643 | 9/1971 | Kimura et al. | 57/277 X |
| 3,768,244 | 10/1973 | Yasutomi et al. | 57/99 X |
| 3,861,130 | 1/1975 | Vidler | 57/277 |

*Primary Examiner*—John Petrakes

*Attorney, Agent, or Firm*—Karl F. Ross; Herbert Dubno

[57] ABSTRACT

An improved ring spinning machine for making a filled bobbin of yarn, thread or the like comprises at least one ring rail which moves up and down near a plurality of spindles driven by a ring rail drive. A control for the ring rail drive in case of an unforeseen machine stoppage, is arrayed so as to cause the ring rail drive, when it would otherwise drive the ring rail in the upward direction on restart because the ring rail was moving up at the time of shut-off, to reverse so that the ring rail moves downward no later than the time of restart of the spindles, so that the ring rail moves downward after the unforeseen machine stoppage at the beginning of restart thus providing for a safer, more reliable spinning operation.

10 Claims, 2 Drawing Figures

RING-SPINNING OR RING-TWISTING MACHINE WITH RESTART CONTROL

FIELD OF THE INVENTION

My present invention relates to a ring-spinning or ring-twisting thread or yarn making machine comprising a plurality of spindles with bobbins (spindle bank) on which the thread, yarn or the like is wound, a spindle drive, at least one ring rail movable up and down past the spindles by a ring-rail drive so that the strands wound about the bobbin are properly twisted and positioned during winding thereon by the traveler riding the rail, and control means for operating the drives for the spindles and the ring rail. More particularly, the invention relates to an improved control means for operating and positioning the ring rail after an unforeseen machine stoppage so that the spinning machine may be safely and easily restarted.

BACKGROUND OF THE INVENTION

At the time of each restart of a ring-spinning or ring-twisting thread making machine, normally strand breakage occurs intermittently and, to be sure, occurs with the ring-spinning machine more frequently than with the ring-twisting machine.

It is a known, empirically recognized fact that the number of strand breaks, happening when such a machine is restarted from a standstill during the acceleration period, are essentially greater if the ring rail or rails are moved upwards at the moment of restart by the spinning or threading machine.

The thread-break count is substantially smaller if the ring rail or rails move at the time of restart toward a lower position.

It is therefore common in such ring-spinning machines, if the machine is stopped to exchange an empty bobbin for a full bobbin, to lift the ring rail or rails from their random position at the moment of stoppage to one which is half the height of the bobbins and to move them first on restart of the machine in the downward direction.

However, stoppage of such a ring-spinning or ring-twisting machine, when occurring other than for exchange of bobbins, is usually due to an interference even which interrupts the normal wind-up of the strands.

Such latter-type stoppages may occur through manual or automatic emergency switch-off or power failure. After elimination of the interference causing the emergency shutdown or power failure, the machine resumes the thread winding on the bobbins without the aforementioned spool changes.

It is therefore inevitable that the machine, upon such resumption, restarts the ring rail in the same operating direction that it had at the cessation of its operation, so that the ring rail frequently runs in the upward sense with resultant higher strand-breaking count.

OBJECT OF THE INVENTION

Accordingly, it is the object of this invention to produce a ring-spinning or ring-twisting machine which has a reduced strand-break count during restart of the machine from a halted configuration caused by an emergency switch-off or power failure.

SUMMARY OF THE INVENTION

This object and others which will become apparent hereinafter are attained in that control means are provided for unforeseen machine stoppages which cause the ring-rail drive, when it would run the ring rail in the upward direction on restart of the spindles, to reverse itself at the latest at a restart moment when the ring rail commences to move in a downward direction on restart of the spindles; thus, in this way the ring rail runs in a downward direction upon restart following the unforeseen machine stoppage.

In this manner, the invention ensures running the ring rail or rails in the downward direction for the above-mentioned purpose at subsequent restart of the machine after power failure or emergency shutoff, in any case when the ring rail is not already found in its lowest position.

According to the invention, the ring-rail drive has a curved cam for causing relative motion of the ring rail and bobbin; cooperating therewith is drawing means to operate the ring rail. A cam plate control means is provided which signals a cam plate drive when the cam plate finds itself in a position in which the ring rail would be driven upwards on restart; at such signal the direction of the cam plate drive is temporarily reversed on restart so that the ring rail moves initially downward on the restart.

It is also known that the drive of the ring rail may be either a hydraulic or an electric motor, which is reversed in its rotation direction by a separate reversing apparatus. This reversing apparatus acts to reverse the ring-rail drive motor whenever restart occurs at a point in the operating cycle when the ring rail is not moving downward.

The novel apparatus according to the invention ensures that the ring rail will come running upwardly at the start of a rerun after a machine stoppage, if the ring rail should by chance be in its lowest position at stoppage. Relatively seldom though it may be that the machine will halt through power failure or emergency shutoff, it is even rarer for the ring rail to be exactly at its lowest position at the moment of such a stoppage.

I preclude this rarely occurring case by providing, according to my invention, a testing apparatus which senses whether the ring rail is at its lowest position when an unforeseen machine stoppage occurs and runs the ring-rail drive for a short measured time to raise the ring rail from that lowest position to an intermediate position, for example one-half the height of the spindles above its lowest position, thus enabling the ring rail to be run in the downward direction on restart of the machine and thereby to prevent or minimize the possibility of a thread break.

BRIEF DESCRIPTION OF THE DRAWING

The novel features and advantages of this invention will now be made more apparent by the following detailed description with reference to the accompanying schematic drawing. Two specific embodiments of the invention are shown in this drawing wherein.

SPECIFIC DESCRIPTION

Figure 1:
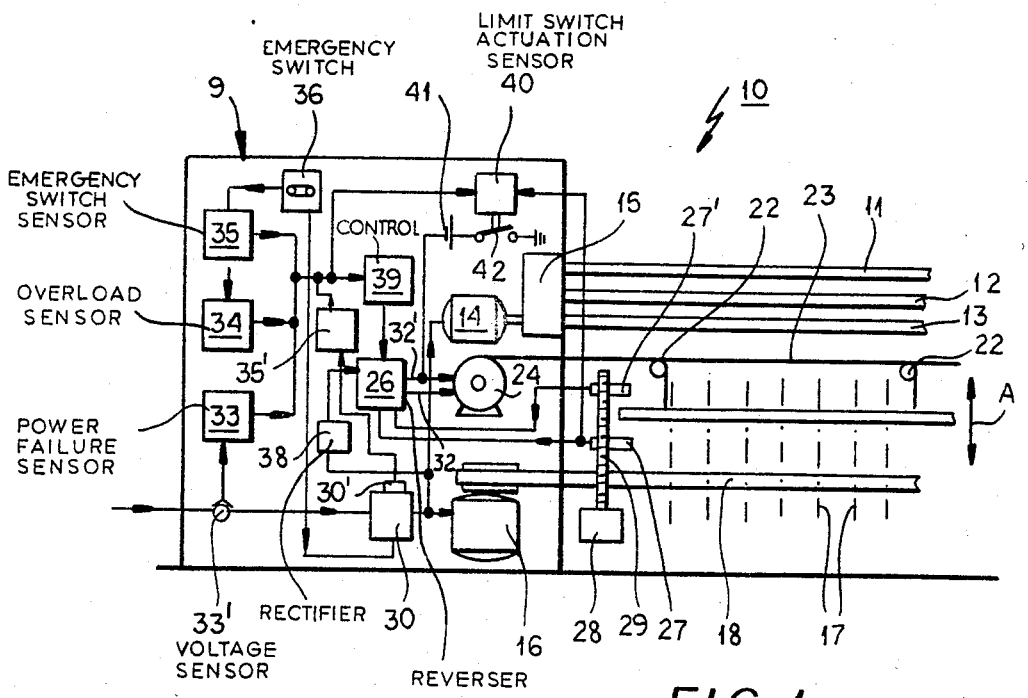
FIG. 1 is a cross-sectional view of a ring-spinning machine with its drive shown from the front.

In the drawing, a ring-spinning machine 10 has a drive support 9 and a plurality of pairs of draft rollers extending lengthwise to one another from the drive support 9. The lower draft rollers 11, 12 and 13 of the pairs are illustrated in FIG. 1; the upper rollers pressing on these lower rollers 11, 12, 13 are not illustrated. An electric motor 14, which drives the rollers 11, 12, 13, operates through a gear box 15 so as to have predetermined adjustable speed characteristics.

A second electric motor 16 is provided which operates a tangential belt 18 driving the wheels of spindles 17 of the ring-spinning machine 10. Further, a ring rail 21 is spaced from and positioned near a row of spindles 17 on which are accommodated a group of bobbins, not shown, penetrated by the spindles. The traveler ring or spinning ring riding each rail 21 around the respective spindle has also not been shown.

The ring rail 21 is moved by means of chains 23 supported by a stationary guide pulley 22 or the like. The ring rail 21 is operated by motor 24 which engages chains 23 so as to move ring rail 21 up or down by the spindles 17 in the direction of double arrows A as shown in FIG. 1. Only the electric motor 24 serves as the drive for this ring rail 21 and, in turn, for an unshown second ring rail, and is provided with a nonillustrated chain roller on which the chains 23 are wound and unwound.

For this purpose the motor 24 is reversible in its direction. By means of limit switches 27 and 27' the motor rotation-direction reversing apparatus 26 controls the ring rail 21 as to the direction of its motion and the limits thereof. These limit switches 27 and 27' are moved by means of a geared spindle 29 driven by a stepping mechanism 28 to properly position thread on the bobbins of the spindles 17 during wind-up of the thread on the bobbin, particularly so that one step corresponds to a single ring rail cycle.

A master switch 30 serves to engage or start the operation of the machine 10. It also serves to normally disengage the machine 10 for the purpose of subsequent replacement of full bobbins with empty bobbins. Master switch 30 is provided with a main power conductor 31 which supplies power for machine 10.

The reversing apparatus 26 is connected in series with a rectifier 38 and the motor 24 is electrically connected to both terminals of the reversing apparatus 26 by conductors 32 and 32'. The upper conductor 32' serves to supply the motor 24 with current to move the ring rail 21 upward and the lower conductor 32 serves to supply the motor 24 with current to lower ring rail 21.

Three sensors or indicators 33, 34 and 35 are provided which report unforeseen machine stoppages. The indicator 33 senses when the main conductor 31 is dead during a power failure. Indicator 33 is provided with a voltage sensor 33' which measures the voltage in the main conductor 31.

The indicator 34 reports automatically caused unforeseen and unintentional machine stoppages, for example machine shutoff because of overheating of a motor or a machine part due to strong stress or the like, i.e. overload.

The indicator 35 reports when a manual emergency switch-off of the machine is activated by means of a mechanically operated emergency switch 36. Naturally, it is possible to provide other additional indicators, sensors or monitors which report machine stoppages and various other emergency conditions.

The indicators 33, 34 and 35 can be independently supplied with current, for example by a battery 41 instead of by the main machine power source.

When one of the indicators 33, 34 or 35 is activated during a shutoff, it triggers a control element 39 to act on reversing unit 26 to engage the ring rail 21 during an upward motion of the latter so that, on restart, the ring rail 21 will reverse direction but the unit 26 will be reversed or disengaged from the rail 21 during a downward motion of the latter. It will also be reversed at first upward motion of the ring rail 21 when the latter operates the lower limit switch 27.

Thus, after an unforeseen machine stoppage by any of the indicators 33, 34 or 35, the ring rail 21 will run in the downward direction at the beginning of restart, as long as it is not at its lowest turning point or lowest position.

In the latter case, then, the ring rail 21 will move upward for a predetermined time interval, for example that corresponding in distance to about half the height of its bobbins. The reversing unit 26 will then be engaged by the control element 39 so as to effect downward motion of the ring rail 21 on restart of the machine. For this lifting of the ring rail 21 during shutoff, a battery 41 and also a test apparatus 40 are provided. The test apparatus 40 senses whether the lower limit switch 27 is momentarily activated by the ring rail 21, that is whether the ring rail 21 finds itself at its lowest turning point or position.

The test apparatus 40 detects further whether one of the indicators 33, 34 or 35 is activated, indicating a stoppage. When both conditions are met at the same time, that is when the limit switch 27 and at least one of the indicators 33, 34 or 35 are activated simultaneously, a switch 42 is closed for a predetermined time during which the motor 24 and battery 41 drive the ring rail 21 upward to an extent such that the rail 21 will move—from its lowered position or its lowest turning point—a desired distance of, say, half the height of the bobbins.

Figure 2:
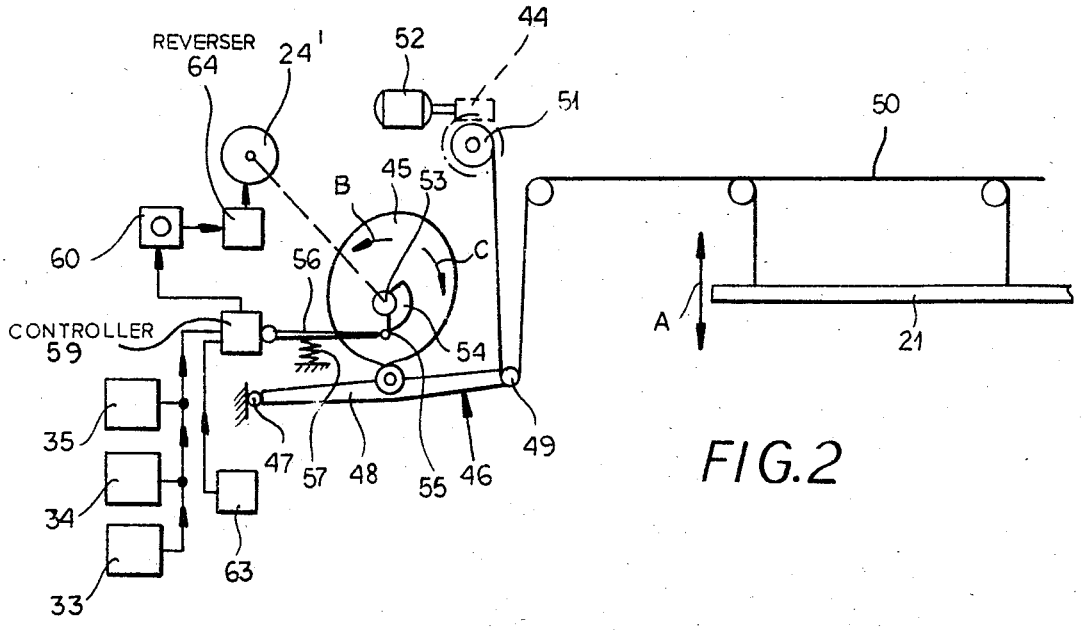
FIG. 2 is a cross-sectional view showing a drive for a ring rail in a second embodiment of the ring-spinning machine of this invention.

In a second embodiment of the invention, as shown in FIG. 2, the drive stroke of the ring rail 21 results from a lifting and pulling drive 46 operated by a cam plate 45 which rotates at a constant angular velocity about a fixed pivot by an electric motor 24'. The motor 24' drives only the cam plate 45. This cam plate urges a rotatable retaining lever 48 about the fixed pivot point 47. At the free end of the lever 48 a roller 49 pivotally guides the movable chains 50 for moving the ring rail 21 up and down. These chains 50 are partially wound on a roller 51 which, after each stroke of the ring rail 21, lets out or takes up an increment of the chains 50 by means of an electric motor 52 engaged with it by a worm gear 44. Thus, by the foregoing means in this second embodiment, the strands are wound about the bobbins on the spindles 17 to neatly form a cop.

The chains 50 carry the ring rail 21 which is guided by an unshown guide linkage and move under control of the cam plate 45 during the stroke displacement and by means of motor 24' up and down.

On the shaft 53 of cam plate 45 a circular segment 54 is clamped that cooperates with a feeler roller 55 attached to a feeler lever 56 extending rotatably from a control apparatus 59.

This feeler lever 56 is pressed up by a spring 57 so that feeler roller 55 presses on the circular segment 54 or on the shaft 53 according to the angular position of cam plate 45. So long as feeler lever 56 presses on the segment 54, this means that the cam plate 45 finds itself in an angular position in which the cam plate, rotated in its normal rotational direction according to arrow B, moves the ring rail 21 downwards, but as long as the feeler roller 55 presses on the shaft 53 directly, the cam plate 45 finds itself in an angular position in which it rotates in the normal rotational direction (arrow B) and moves the ring rail 21 upwards.

The position of lever 48 will be governed by a control apparatus 59, which controls a timed relay 60, that reverses the rotation direction of the electric motor 24' for a predetermined short time by means of a reversing unit 64 and, to be sure, always when, and only when, the following three conditions are met jointly:

Condition 1—One of the indicators 33, 34 or 35 must indicate that a stoppage has occurred. These indicators 33, 34 and 35, as well as the control unit 59, are shown in FIG. 2 and correspond to those described in the embodiment of FIG. 1. This condition and those following naturally arise because of the need to restart a machine stopped by some unforeseen event such as a power failure or machine fault.

Condition 2—The lever 48 of the control apparatus 59 must signal that the cam plate 45 is in a position in which, when rotated in its normal direction as shown in FIG. 2 (arrow B), it moves the ring rail 21 up, not down.

Condition 3—The control apparatus 59 must indicate by an indicator 63 when the restart of the machine begins.

When all three conditions are jointly fulfilled, the control apparatus 59 immediately switches the time relay 60, whereby the reversing controller 64 immediately reverses the direction of electric motor 24' so that the cam plate 45 will then be driven for a short measured time by the time relay 60 at the beginning of the restart. As a result, the ring rail 21 will be lowered. Immediately after the time relay 60 has measured out its appointed time interval, it terminates the reversal of the direction of electric motor 24' by means of reversing controller 64 and the ring rail 21 will be lowered no further; the electric motor 24' will now again be driven in its normal direction (arrow B in FIG. 2) by cam plate 45.

The machine 10 according to FIG. 1 can be so constructed that the test apparatus 40 will not only signal when the ring rail 21 is in its lowest position or at its lower turning point at the beginning of an unforeseen machine stoppage, but also will signal when it finds itself a short distance, for example 5 to 10 mm above that position. For this purpose an additional sensor can be attached to the support of the lower limit switch 27 which senses and grasps this small distance difference in the position of ring rail 21 so that when the latter finds itself in this sensor-adjusted position the test apparatus 40 still signals.

In this kind of spinning or twisting machine it frequently occurs that the operator stops the machine after an "offtake" or for a desired break in machine operation, for example on account of the finishing of a work period or other reasons.

By an "offtake" one understands that one simply feeds an empty bobbin with yarn or the like until it is full. An "offtake" begins also with the winding of yarn on the at first empty bobbin and it ends when the bobbin or the spool on the spindle is full so as to necessitate an exchange for a new empty bobbin or spool.

Hitherto in practice one begins a temporary stoppage before the end of an "offtake" so that the operator, who will stop the machine for the purpose of a temporary machine halt, can observe the ring rail 21 and the switches which serve to bring about the stoppage and then manually adjusts the ring rail 21, when it is found not running down, so that it will run down on restart.

The invention has accordingly simplified these operations. The operator need no longer be concerned with the machine restart. The ring rail 21 usually finds itself far from the lower turning point at the time of disengagement. However, the operator can undertake the desired temporary stoppage at an arbitrary time with the switches properly set up. In this way, among other things, time will be saved and operational errors will be avoided, since the ring rail will run in the downward direction on restart. An additional switch 30' is provided for this purpose as shown in FIG. 1. This additional switch 30' attached to the main switch 30 serves to achieve the desired switching off of the machine at the end of the "offtake". The switch 30' activates an indicator 35' which then exerts the same function as the indicators 33, 34 and 35 when one of them is activated so that this indicator 35', in cooperation with the control element 39 and the test apparatus 40, causes the ring rail 21 on restart of the ring-spinning machine 10 to run downward and thus to minimize the possibility of strand breaking at the beginning of restart.

I claim:

1. A machine for producing a yarn bobbin comprising:

at least one ring rail which moves up and down, a plurality of spindles, a ring rail drive to drive said spindles, a control means for said ring rail drive, which, in case of unforeseen machine stoppage, causes said ring rail drive, when said ring rail drive would otherwise drive said ring rail in the upward direction on restart because said ring rail had been moving upward at the instant of shut-off, to reverse so that said ring rail motion direction is downward no later than the time of said restart of said spindles, so that said ring rail runs in said downward direction after said unforeseen machine stoppage at the beginning of said restart.

2. The machine defined in claim 1 in which said ring rail drive comprises:

a driven cam plate, and a sensor connected to said control means which signals said control means whether said cam plate has halted at a position which would cause said ring rail to move upwards on restart, said signal causing said control means to reverse the direction of rotation of said cam plate for a short measured time on restart of said spinning machine.

3. The machine defned in claim 2 further comprising:

a drive shaft on which said cam plate pivots, and a rotable feeler lever acting as said sensor extending from said control means a distance sufficient to reach said shaft, and a circular segment conformed, positioned and attached to said shaft of said cam plate, a spring pressing said feeler lever toward said shaft to engage said circular segment when said cam plate moves said ring rail downwards, but engages said shaft of said cam plate when said cam plate moves said ring rail upwards, and thus signals said control means whether said ring rail is moved up or down by further rotation of said cam plate in the normal unreversed direction of rotation.

4. The machine defined in claim 1 further comprising:

a motor serving as a ring rail drive, and a drive reversing apparatus connected to said motor and to said control means capable of reversing the direction of said ring rail when said machine is restarted after an unforeseen stoppage, if said ring rail would have otherwise moved upward on restart.

5. The machine defined in claim 1, further comprising a testing means which tests whether said ring rail is substantially at the lowest position of the up and down motion cycle of said ring rail after an unforeseen machine stoppage and signals said control means if said ring rail is at said lowest position so as to activate said ring rail drive for a preset time interval, so that said ring rail is moved to a restart position higher than said lowest position, so that said ring rail may be moved downward on subsequent restart of said machine.

6. The machine defined in claim 5 wherein said preset time interval is of a sufficient duration to position said ring rail substantially at half the height of said spindles above said lowest position of said ring rail.

7. The machine defined in claim 1, wherein said control means comprises a plurality of electrical indicators communicating with one another by changes in electric current, at least one of said electrical indicators being provided for emergency stoppages of said machine.

8. The machine defined in claim 7, wherein at least one of said indicators is provided for manual stoppages of said machine.

9. The machine defined in claim 7, further comprising an additional temporary halting control means to be controlled by the machine operator, whereby said additional control means is structured so as to act on said ring spinning machine to provide a temporary halt between two normal stoppages for bobbin changing.

10. A method of operating a spindle bank having a ring rail and winding yarn on respective bobbins on respective spindles of said spindle bank, comprising the steps of:

(a) detecting at least one indication of unforeseen stoppage of the spindle bank including:

(i) failure of electrical current supply to a drive motor for said bank, (ii) mechanical overload, and (iii) emergency switch operation;

(b) automatically determining the position of said ring rail upon the development of said at least one indication;

(c) at the latest upon restarting of said spindle bank switching over automatically the direction of operation of a drive for said ring rail if the position of said ring rail is such that it would tend to rise upon startup, thereby ensuring that said ring rail will move downwardly on startup; and (d) restarting said spindle bank.

* * * * *